US010889391B2

(12) United States Patent
Christophel

(10) Patent No.: US 10,889,391 B2
(45) Date of Patent: Jan. 12, 2021

(54) ZIPPER CLOSER

(71) Applicant: Pouch Pac Innovations, LLC, Sarasota, FL (US)

(72) Inventor: Emmanuel K. Christophel, Punta Gorda, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 281 days.

(21) Appl. No.: 15/656,753

(22) Filed: Jul. 21, 2017

(65) Prior Publication Data

US 2018/0022484 A1 Jan. 25, 2018

Related U.S. Application Data

(60) Provisional application No. 62/365,054, filed on Jul. 21, 2016.

(51) Int. Cl.

| | |
|---|---|
| ***B65B 7/02*** | (2006.01) |
| ***B65B 43/50*** | (2006.01) |
| ***B65B 43/46*** | (2006.01) |
| ***B65B 51/04*** | (2006.01) |

(52) U.S. Cl.
CPC ..... *B65B 7/02* (2013.01); *B65B 43/465* (2013.01); *B65B 43/50* (2013.01); *B65B 51/046* (2013.01)

(58) Field of Classification Search
CPC ..... B65B 7/02; B65B 7/06; B65B 43/465; B65B 51/00; B65B 51/16; B65B 61/188
USPC ..... 53/133.4, 139.2, 284.7, 373.2, 375.4
See application file for complete search history.

(56) References Cited

U.S. PATENT DOCUMENTS

| | | | | |
|---|---|---|---|---|
| 2,358,125 | A * | 9/1944 | Anderson | B65D 33/1666 493/334 |
| 4,665,552 | A * | 5/1987 | Lems | B65B 43/267 383/37 |
| 4,727,709 | A * | 3/1988 | Zieke | B65B 9/13 226/17 |
| 6,675,552 | B2 * | 1/2004 | Kunz | B65B 9/067 493/213 |
| 2008/0247682 | A1 * | 10/2008 | Murray | B65D 75/5805 383/104 |
| 2012/0186195 | A1 * | 7/2012 | Moeller | B65B 67/06 53/373.2 |

* cited by examiner

*Primary Examiner* — Anna K Kinsaul
*Assistant Examiner* — Veronica Martin
(74) *Attorney, Agent, or Firm* — Dinsmore & Shohl LLP

(57) ABSTRACT

A zipper closure device for use with a turret type flexible pouch fill machine. The zipper closer device has a pair of rollers supported by an arm which is permitted to oscillate within a support module. The support module is mounted such that the rollers oscillate in a radial direction with respect to the access of rotation of the turret. The support module is supported by an arm in a post which permits positioning of the closer device with respect to the position of the pouches to be closed.

7 Claims, 6 Drawing Sheets

FIG. 5
PRIOR ART
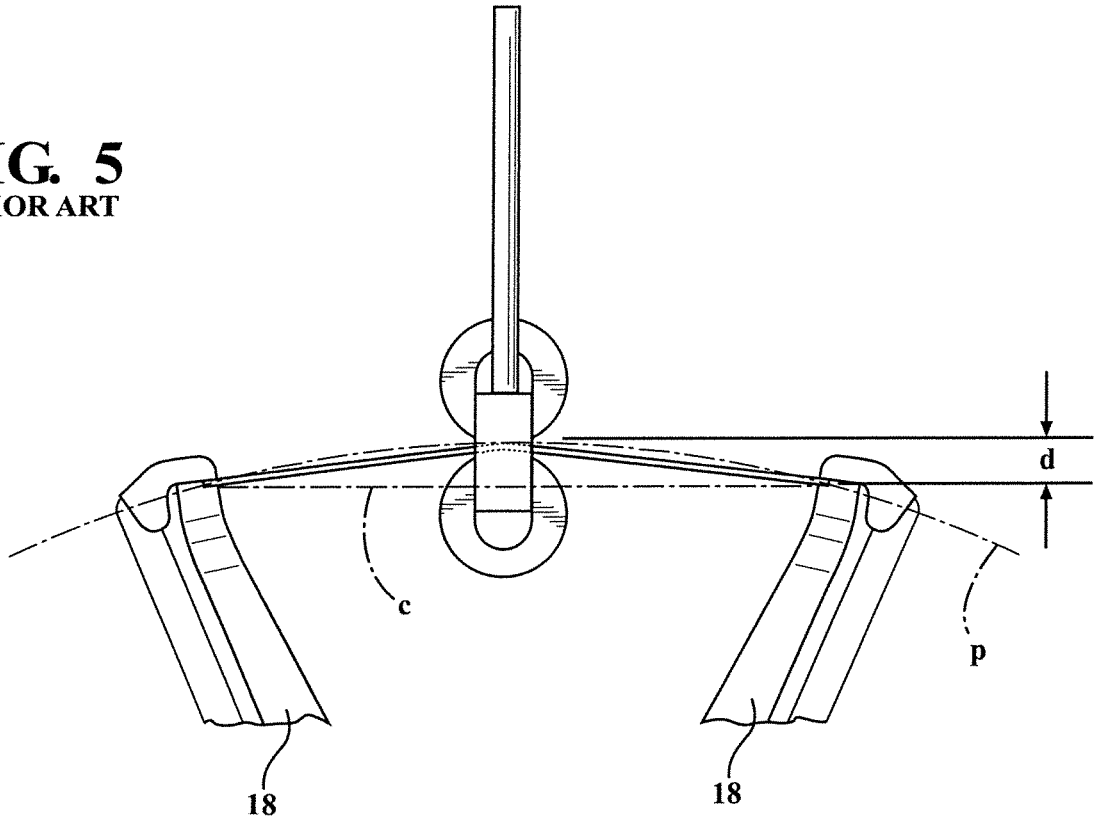
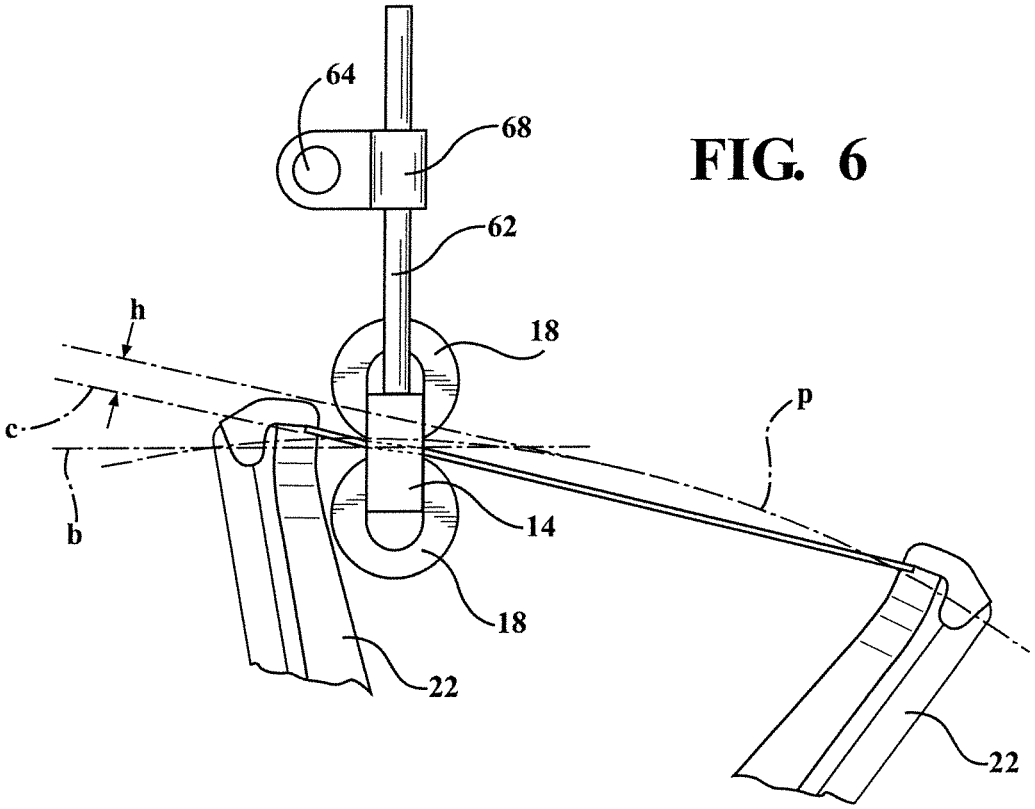
FIG. 6

ZIPPER CLOSER

BACKGROUND OF THE INVENTION

It is well known to produce plastic pouches with a plastic zipper. The zipper is formed from two interlocking strips of plastic. One strip is mounted to the inner side of one panel and the other strip is mounted on the inside of the after panel. A top seal is frequently formed on the pouch above the closed zipper. The pouches typically are filled with product and sealed on turret style machines in which the pouch is supported by a pair of grippers, each gripper holding a side seal of the pouch. The turret rotates to deliver the pouch through a number of stations where the pouch is opened, filled with product, and the zipper closed. Typically, the zipper is closed by a pair of wheels which are spaced apart so that there is a small gap between the circumferences of the wheels. The pair of wheels are supported above gripper to receive the top of the power. Rotation of the grippers pulls the top of the pouch with the zipper through the gap between the wheels. The wheels force the zipper elements together to close and seal the pouch.

However, it is found that such an arrangement may unduly stress the pouch because the top of the pouch does not follow the circumference of the circle formed by the circular path traveled by the grippers. The top of the pouch is held by the grippers to extend in a straight line along a cord "c" formed between the grippers. As shown in FIG. 5, as the grippers follow the circular path "p". The rollers pull the pouch away from the cord "c" to a distance "d" cord "c" between the grippers to the circumference. The deformation although small places undue stress upon the top of the pouch as it is stretched from the straight line cord to follow the circumference path of the rollers.

SUMMARY OF THE INVENTION

A device for use with a rotating turret of a packaging machine for closing a zipper closure on a flexible pouch. The device includes a support module for supporting. A top end is pivotally mounted to the support module to permit at the lower end to oscillate radially in a radial direction with respect to a rotational axis of the turret. A pair of rollers are mounted to a lower end of the arm. The rollers are spaced apart to accept the pouch there between. The support module has an inverted u shaped cavity for accepting the top end of the arm. Adjustable stops are provided on the support module to limit the travel of the arm. The device may include the support for positioning the support module and arm over the circumference of the turret. The arm oscillates as the pouch enclosure is moved through the rollers such that the rollers, closure and top of the pouch are maintained on a straight line between the grippers during the closing process.

BRIEF DESCRIPTION OF THE DRAWINGS

FIG. 5 is a top view of prior art.

FIG. 6 is a top view of the zipper closer device in operation in accordance with the invention.

DETAILED DESCRIPTION OF THE INVENTION

Figure 1:
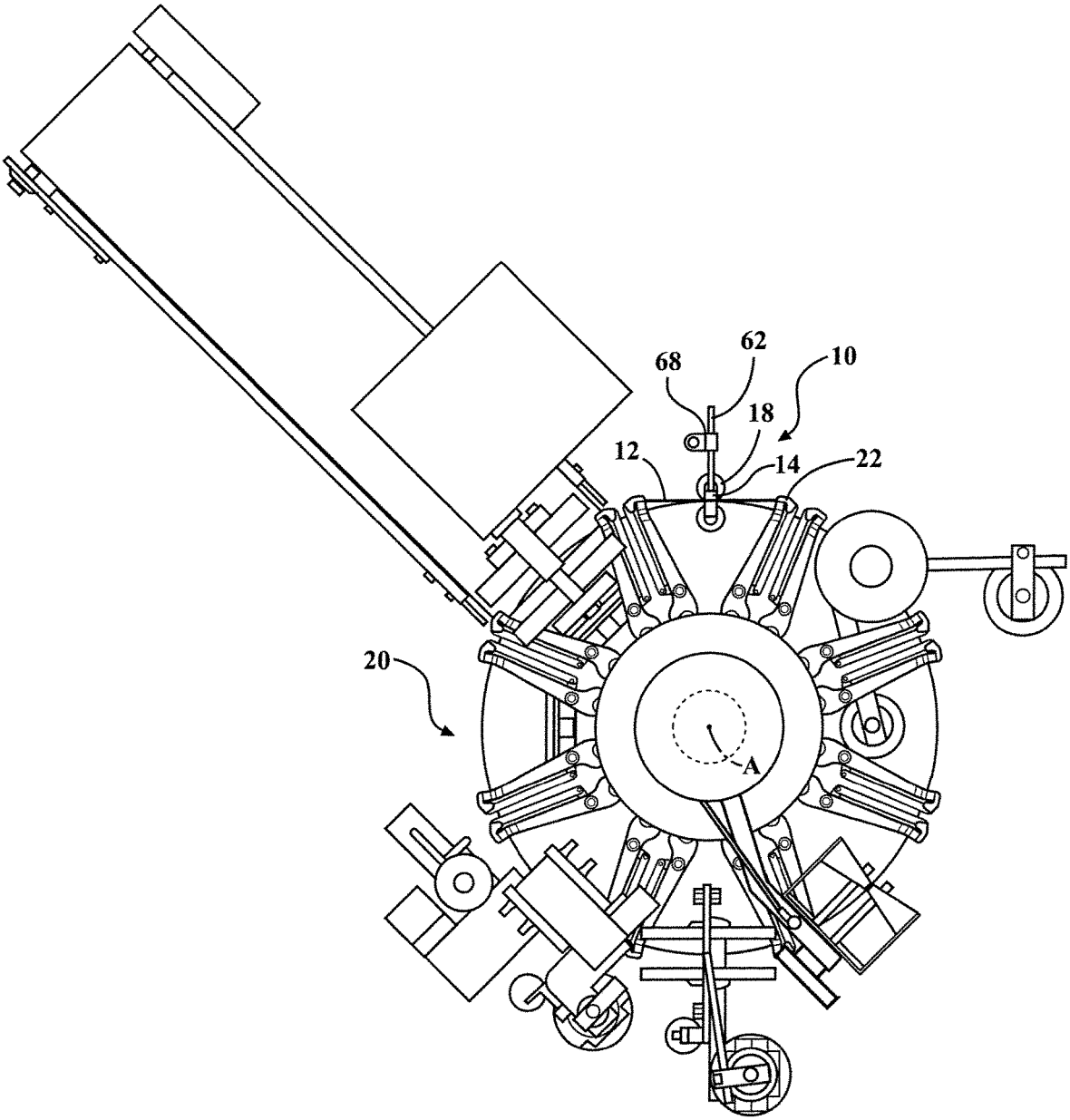
FIG. 1 is a top view of a fill machine turret with a zipper closer device in accordance with the invention.
Figure 2:
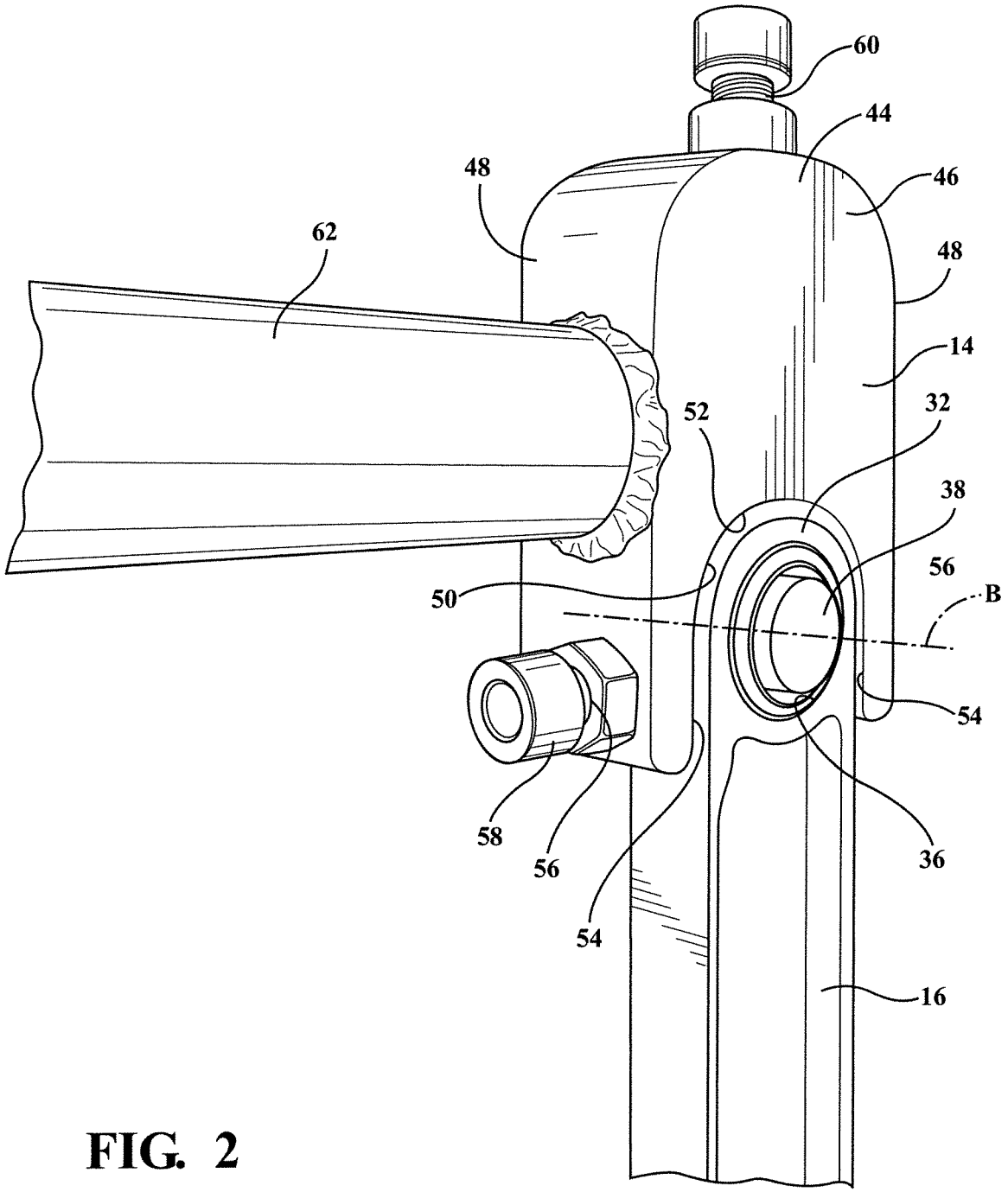
FIG. 2 is a perspective view of the support module in accordance with the invention.
Figure 3:
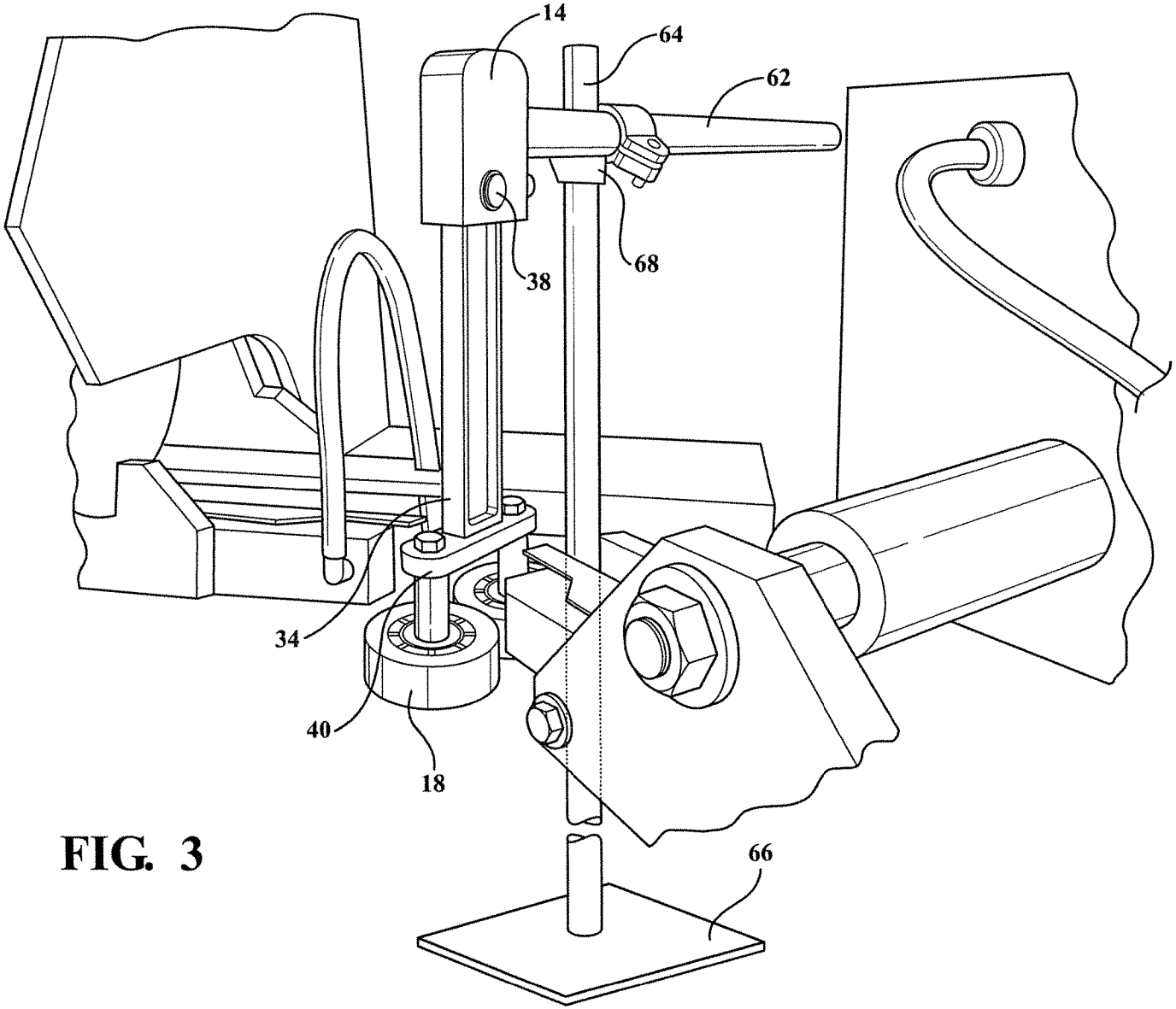
FIG. 3 is a perspective side view of the zipper closer device in accordance with the invention.
Figure 4:
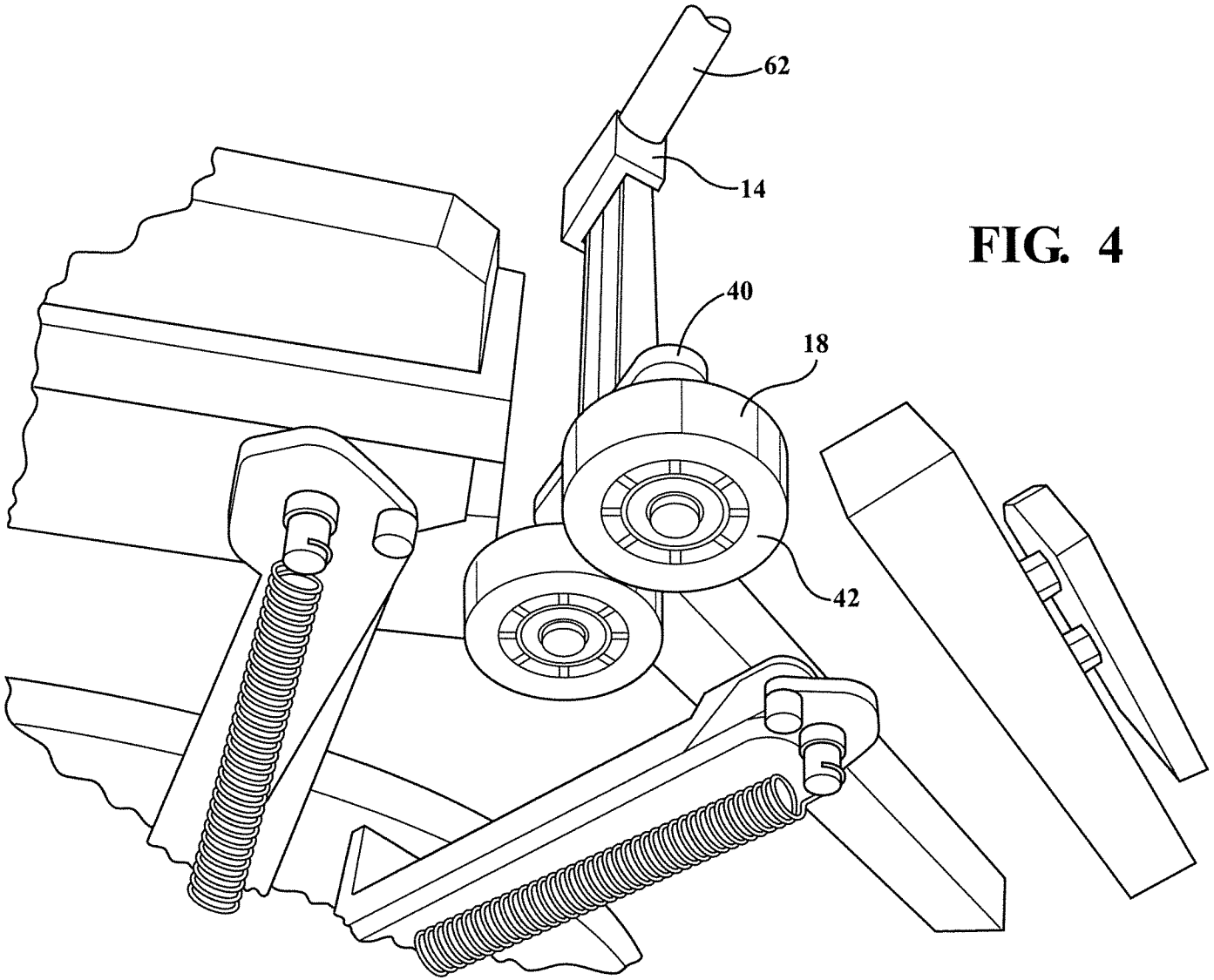
FIG. 4 is a bottom perspective view of the zipper closer in accordance with the invention.

As shown in FIGS. 1-4, a novel zipper closer device 10 for a flexible pouch 12 includes support module 14 supporting an oscillating arm 16 having a pair of rollers 18. The zipper closer device 10 is suitable for use with a turret style filling machine 20 (FIG. 1). As shown in FIGS. 2-4, the arm 16 is pivotally supported as to permit the rollers 18 to oscillate radially inwardly and outwardly with respect to a rotational axis "a" of the turret as the pouch 12 passes through the rollers 18. As shown in FIG. 4, the filling machine 20 has pairs of grippers 22 which support the pouch 12 in a straight line from gripper to gripper. The turret 20 moves the grippers 22 along a circular path "p" through a plurality of stations where the zippers are installed and the pouch is filled. The zippers are then closed by the zipper closer device 10.

Figure 7:
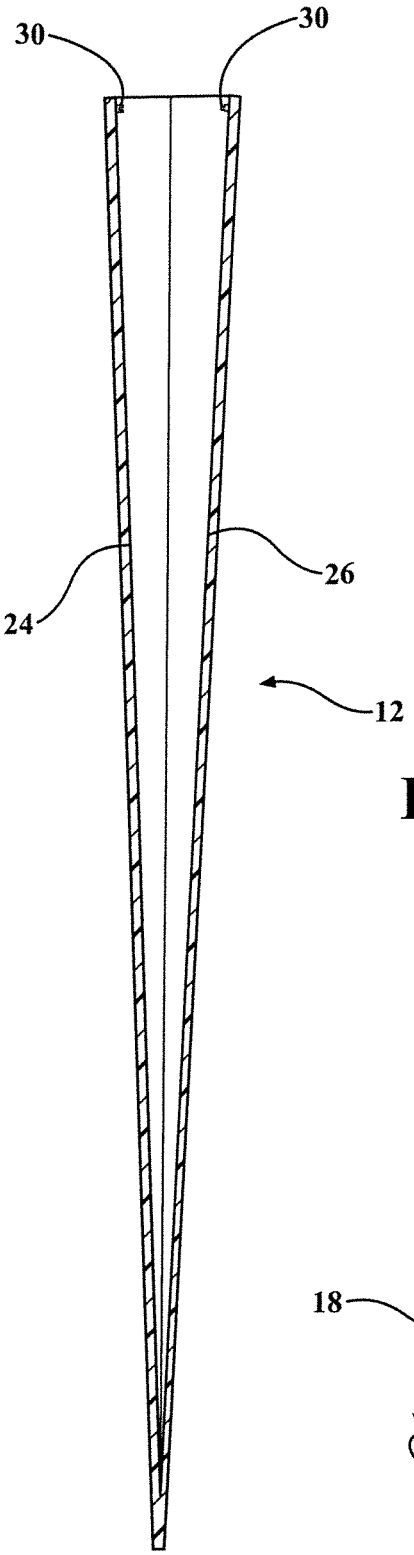
FIG. 7 is a cross-sectional view of a flexible pouch having enclosures.
Figure 8:
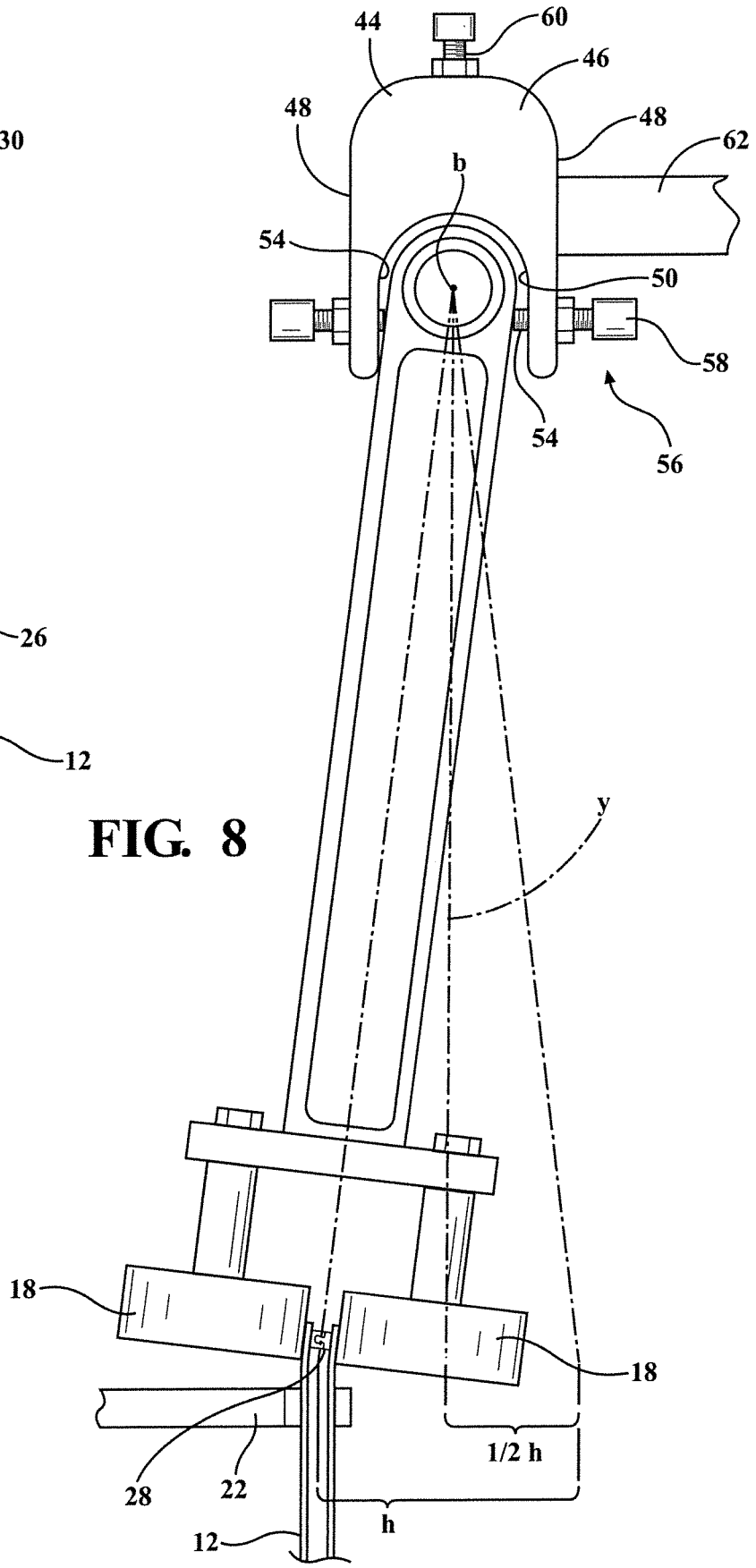
FIG. 8 is a side view of zipper closer during use.

As shown in FIGS. 7 and 8, the pouch 22 has a front panel 24 and a rear panel 26 of flexible material. A plastic zipper 28 is formed of a pair of interlocking strips 30 of plastic. One of the pair of strips 30 is mounted on the inner surface of each one of the panels 24, 26. The strips 30 are mounted near the top of the pouch.

As shown in FIGS. 2 and 3, the oscillating arm 16 is a rigid elongated member having a top 32 and a bottom 34. The top 32 has an inverted U-shape with a bore 34 for mounting to a pin 38 of the support module 14. The top 32 is supported so that the arm 16 can oscillate from side to side with respect to a vertical axis "y".

As shown in FIGS. 3, 4 and 8, a plate 40 is mounted to the bottom 34 of the arm 16 for pivotally supporting the pair of rollers 18. The rollers are separated by a distance equal to the width of the pouch with the zipper 28 so that as the top of the pouch is pulled through the zippers the force of the rollers 18 pushes the strips 30 together. The rollers 18 have a generally cylindrical resilient surface 42 formed of rubber or the like. In order to minimize the distance of travel of the rollers during oscillation the arm is provided with a long length, such as of approximately 170 millimeters. This results in the rollers oscillating through a relatively small number of degrees.

As shown in FIGS. 2 and 8, the support module 14 is block shaped having a top 44, a front wall 46 and a pair of end walls 48. The front wall 46 has an inverted u-shaped recess 50. The recess 50 is defined by a curved top wall 52 and a pair of side walls 54. The pivot pin 38 for supporting the arm 16 is positioned in the recess 50. A threaded stop pin 56 extends through each of the end walls 45 to side walls 54 of the support module top 30 to the arm 16. The threaded pins are threaded to move inwardly and outwardly to act as stops for the pivotal movement of the arm. Knurled grips 58 are fixed to each of the pins 56. A third pin 60 extends vertically from the top 44 into the recess 50. The pin 60 is made of a hard plastic such as Delrin and can be adjusted to put tension on the top 32 of the arm so as to dampen the movement of the arm 16 as it oscillates.

As shown in FIG. 3, the support module 14 is mounted to a cross member 62 which extends on a horizontal axis from an upright post 64. The post 64 extends vertically from a base 66 or from the machine housing. A double tube clamp 68 has one clamp portion which extends about the post 64 and a second clamp portion for adjusting the position of support member 14 and rollers 18. The clamps have pins 70 which extend through clamps to tighten or loosen the clamp to allow vertical adjustment along the post and along the cross post in an inward and outward position with respect to the turret.

OPERATION

As shown in FIGS. 6 and 8, the pouch 12 is supported for rotation by the turret 20 by the pair of grippers 22. The top portion and zipper 28 of the pouch 12 extend above the grippers 22. The grippers 22 rotate on the circular path "p" about a center axis "a" of the turret. The pouch is positioned on a straight line which lies on a cord "c" of the circular path "p" of the grippers 22. The cord "c" has a height "h" or maximum distance between the path "c" and top of the pouch 12. The support arm 16 and rollers 18 are permitted to oscillate from the vertical axis "y" which passes through the pivot axis "b" of the arm. As shown in FIG. 6, the rollers oscillate distance equal to the cord height "h". However, because the rollers can oscillate in two directions from the vertical axis, the distance of travel in each direction is ½ "h" in one direction and ½ "h" in the other direction. As shown in FIG. 6, the pivot axis "b" is then positioned so that the vertical axis "y" of the arm is ½ "h" inwardly of the path "p" of the grippers. As shown in FIG. 8, when the pouch 12 enters the rollers 18, the arm 16 immediately pivots radially inwardly to ½ "h". The path of the rollers has the shape of a sine wave. The arm returns to the vertical axis "x" as the rollers 18 move along the top of the pouch positioned on cord "c". The arm and rollers 18 then move opposite direction ½ "h" which is at the cord height "h". The arm 16 then oscillates back to center and to the start position where the panel exits the rollers. The distance ½ "h" is relatively small distance typically in the range of 0.008-012 inches.

As shown above, the zipper closer apparatus provides a simple, efficient and fully adjustable zipper closer which follows the straight line path of the pouch through its zipper closing operation. The zipper closer reduces the stress that is put on the top and ensures that proper force is maintained on the zipper as it is being closed.

Although discussed with respect to the above preferred embodiment, it will be apparent to those skilled in the art that many variations are possible within the scope of the invention.

The invention claimed is:

1. A device for closing a zipper of a flexible pouch which is supported between a pair of grippers of a turret rotating about an axis of rotation, the device comprising:
   - a support module mounted in a spaced apart, and fixed position with respect to the turret; and
   - an arm having a top end and a lower end; the top end pivotally mounted to the support module, to pivot about a horizontal axis;
   - a pair of rollers mounted to the lower end of the arm, each of the pair of rollers having an axis of rotation which is orthogonal to the horizontal axis wherein the lower end of the arm and the pair of rollers oscillate together inwardly and outwardly with respect to the axis of rotation of the turret as a top of the pouch passes between the rollers.

2. The device of claim 1, wherein each of the pair of rollers has an annular surface.

3. The device of claim 2, wherein the annular surface of each roller is resilient.

4. The device of claim 1, wherein the support module has an inverted u-shaped cavity adapted to receive the top of the arm.

5. The device of claim 1, wherein the support has at least one adjustable stop to limit travel of the arm.

6. The device of claim 4, wherein a pair of stops are mounted to the support, each of the pair of stops extending in to the cavity from opposite sides of the support module.

7. A packaging machine for filling a pouch having a closure, comprising
   - a housing;
   - a turret rotatably mounted within the housing, the turret having at least two spaced apart grippers for supporting a pouch;
   - a support member mounted to the housing and spaced apart from the turret;
   - an arm pivotally mounted to the support to rotate about a horizontal axis; and
   - a pair of rollers mounted to the arm to rotate about an axis orthogonal to the horizontal axis, the pair of rollers spaced apart, to receive a portion of the pouch having the closure, the arm and pair of rollers move as one radially inwardly and outwardly with respect to turret as the closure passes between the rollers.

* * * * *